US012066190B2

(12) United States Patent
Wang

(10) Patent No.: US 12,066,190 B2
(45) Date of Patent: Aug. 20, 2024

(54) SMALL STOVE, STOVE CORE AND SHAPE OF BRIQUETTE ASSORTED WITH SMOKELESS COMBUSTION OF COMBUSTIBLE SOLIDS/SEMISOLIDS

(71) Applicant: Ailin Dai, Shanghai (CN)

(72) Inventor: Qingsheng Wang, Shanghai (CN)

(73) Assignee: Ailin Dai, Shanghai (CN)

( * ) Notice: Subject to any disclaimer, the term of this patent is extended or adjusted under 35 U.S.C. 154(b) by 307 days.

(21) Appl. No.: 17/421,377

(22) PCT Filed: Jan. 7, 2020

(86) PCT No.: PCT/CN2020/070739

§ 371 (c)(1),
(2) Date: Jul. 7, 2021

(87) PCT Pub. No.: WO2020/143637

PCT Pub. Date: Jul. 16, 2020

(65) Prior Publication Data

US 2022/0082261 A1 Mar. 17, 2022

(30) Foreign Application Priority Data

Jan. 8, 2019 (CN) ..... 201910014780.8
Jan. 8, 2019 (CN) ..... 201920025966.9

(51) Int. Cl.
*F24B 1/197* (2006.01)
*F23B 60/00* (2006.01)
*F24H 9/189* (2022.01)

(52) U.S. Cl.
CPC ..... *F24B 1/197* (2013.01); *F23B 60/00* (2013.01); *F24H 9/189* (2013.01)

(58) Field of Classification Search
CPC ..... F24B 1/197; F24B 5/023; F24B 1/181; F23B 60/02; F23B 60/00; F23L 1/00; F24H 9/189; F23M 2900/05004
See application file for complete search history.

(56) References Cited

U.S. PATENT DOCUMENTS

2008/0092437 A1* 4/2008 Helms ..... C10L 5/368 44/520
2013/0112186 A1* 5/2013 Crichlow ..... A47J 37/0718 126/30

(Continued)

FOREIGN PATENT DOCUMENTS

CN 87203691 U 11/1987
CN 2051713 U 1/1990

(Continued)

*Primary Examiner* — Alfred Basichas
(74) *Attorney, Agent, or Firm* — NKL Law; Allen Xue

(57) ABSTRACT

A small stove assorted with smokeless combustion of combustible solids/semisolids, a stove core and a shape of briquette are to ensure that a cylindrical briquette stack is quickly ignited in a smokeless state. A section A stove core inner ring and a flame concentrator are made of a selected high-whiteness aluminum silicate fiber with superior thermal insulation/resistance effects, and are processed for, e.g., blocking the micropores inner circumferential surface, and a stove core outer ring is made of cheaper foam glass, foam ceramic or calcium silicate modules. An underlying briquette with a concave top is designed to enable an easy, convenient and fast alignment of vent holes. The overall cross-sectional area of the vent holes is expanded by 30%-50% as compared with the area of the anthracite briquettes with the same diameter, and the inner ring vent holes are mainly expanded.

5 Claims, 4 Drawing Sheets

(56) References Cited

U.S. PATENT DOCUMENTS

| | | | | |
|---|---|---|---|---|
| 2019/0330550 | A1* | 10/2019 | Wang | C10L 5/04 |
| 2021/0179958 | A1* | 6/2021 | Wang | C10L 9/10 |

FOREIGN PATENT DOCUMENTS

| | | | |
|---|---|---|---|
| CN | 2254997 | Y | 5/1997 |
| CN | 1217449 | A | 5/1999 |
| CN | 1218889 | A | 6/1999 |
| CN | 101117457 | A | 2/2008 |
| CN | 201411447 | Y | 2/2010 |
| CN | 110410776 | A | 11/2019 |
| DE | 202008002567 | U1 | 7/2008 |

* cited by examiner

SMALL STOVE, STOVE CORE AND SHAPE OF BRIQUETTE ASSORTED WITH SMOKELESS COMBUSTION OF COMBUSTIBLE SOLIDS/SEMISOLIDS

CROSS REFERENCES TO RELATED APPLICATIONS

The present application is a U.S. national stage entry of International Application No. PCT/CN2020/070739, filed Jan. 7, 2020, which claims the priority to Patent Application CN 201920025966.9 entitled "SMALL STOVE, STOVE CORE AND SHAPE OF SAME ASSORTED WITH SMOKELESS COMBUSTION OF COMBUSTIBLE SOLIDS/SEMISOLIDS", filed on Jan. 8, 2019, to China National Intellectual Property Administration, and Patent Application CN 201910014780.8 entitled "SMALL STOVE, STOVE CORE AND SHAPE OF SAME ASSORTED WITH SMOKELESS COMBUSTION OF COMBUSTIBLE SOLIDS/SEMISOLIDS", filed on Jan. 8, 2019, to China National Intellectual Property Administration, which are incorporated herein by reference in their entirety.

TECHNICAL FIELD

The present invention relates to the efficient and clean combustion control technology for combustible solids and semisolids, and in particular, to technologies for a stove which is suitable for the field of non-forced combustion and assorted with smokeless, efficient and clean combustion of a shaped fuel block (hereinafter referred to as briquette) containing bituminous coal, other combustible solids/semisolids and auxiliary materials, and is usually (but not always) small and medium in size, and its stove core and a shape of briquette.

The present application exemplifies a cylindrical briquette with a diameter of 100 mm and assorted stove, stove core and flame concentrator for illustrative purpose, and includes, but is not limited to, stoves for non-forced combustion purpose of various shapes, structures, sizes and uses, and assorted stove cores and briquettes that can be conveniently manufactured as needed according to the techniques of the present invention. Among these, the stove core and the flame concentrator are either suitable for high-volume production in modules, or conveniently and quickly used to modify a stove by cutting and combining prefabricated standard modules on site in a building block manner.

Percentages relating to weight in the application refer to the parts by mass.

The term "volatile component" has the same meaning as the parent patent (Application No. 201810390637.4), i.e., including volatile matters in coal and other organic matters in the composition containing carbon, hydrogen, oxygen, sulfur, nitrogen and other elements which may evaporate to produce fuel gases at 300° C. or below.

BACKGROUND

The present invention relates to details of the techniques for thermally insulating/refractory stove core assorted with a small stove as shown in FIG. 1 and expanding the overall cross-sectional area of vent holes in Patent Application No. 201810390637.4, entitled "SMOKELESS COMBUSTION FOR BITUMINOUS COAL, LIGNITE, BIOMASS FUELS AND WASTE PLASTICS SUCH AS POLYOLEFIN" filed on Apr. 27, 2018 by the applicant. The present invention also supplementarily illustrates a simplified method for aligning vent holes, and a range and method for adjusting the height of large combustion chamber, and sufficiently disclosed their parameters.

It is known from the parent patent (Application No. 201810390637.4) and the Specification and FIG. 1 of the present invention that, in addition to core technologies such as the formulation and the manufacturing process of the pyrophoric paste/cake (8) and pyrophoric briquette (10), for the purpose of conveniently igniting a briquette stack without smoke in a small simple stove even in a freezing cold weather, and forming a high-temperature region by adding a pyrophoric briquette section (10) in a large combustion chamber (7) as soon as possible, such that the scorching briquette region can move down faster according to the design speed to keep long flame combustion in most of the time and to keep an efficient and clean combustion in a smokeless state with a high sulfur fixation rate and a high thermal efficiency in the whole process, the material selection and manufacturing techniques of the section A stove core inner ring (2), the section A stove core outer ring (17) and the flame concentrator (6) with superior thermal insulating/refractory performance are also important.

In the briquette stack of beehive vent holes established by the parent patent (Application No. 201810390637.4), in order to maintain a long-term combustion, 2-3 underlying briquettes (9) with a dry weight of 500 g and a height of 90 mm are stacked. This brings difficulties in aligning vent holes between upper and lower briquettes, particularly for the widely used briquettes with a minimum diameter of 100 mm (commonly known as "coalball" in north China), and may easily lead to serious accidents of fuming and combustion on the surface of a part of or even most briquettes. Accordingly, there is a need of technical measures for solving this potential risk.

Existing lower ignition mode ignites an anthracite briquette with a diameter of 100 mm. The overall cross-sectional area of the vent holes is about 1356 square millimeters as measured and is too small to meet the requirements of burning briquettes with the same diameter of the series of the present invention. Particularly, a pyrophoric briquette (10) with a volatile component of more than 40% and a high oxygen consumption during fast combustion may easily produce dark smoke, which is obviously caused by insufficient ventilation. In addition, a small combustion chamber over the briquette stack will fail to satisfy the complete combustion of a large amount of fuel gases produced by high volatile component content. The two problems must be solved by technical measures to implement an upper ignition mode for a small stove having greatest difficulties in igniting the briquette stack, such that even in a freezing cold weather, a complete combustion of smokeless state in the whole process may be realized from the moment of ignition.

SUMMARY

1. The technical problem to be solved by the present invention is as follows:

a. Pursuing a cheap material with superior thermal insulation/fire resistance performance which is suitable for long-term use at 1000° C. The material shall either be suitable for high-volume production of stove cores and flame concentrators of different shapes and sizes for various stoves in modules, or conveniently and quickly used to modify a stove by cutting and combining prefabricated standard modules on site in a building block manner, such that, in adverse conditions of increased stack of briquettes with the minimum diameter, freezing cold weather and the like, the technical requirements of successful ignition in a smokeless state and an efficient, clean and smokeless combustion are met.

b. Pursuing a simple and quick method of aligning vent holes of cylindrical briquette with a diameter of 100 mm, such that each part of the pyrophoric briquette (10) with the volatile component of more than 40% can acquire sufficient air volume for a complete combustion.

c. Pursuing an expanded ratio of the overall cross-sectional area and a proper arrangement for vent holes, such that the central main torch of the flame concentrator (6) will obtain a combustion effect similar to multiple oxygen supplies, and a proper height of the large combustion chamber (7) to meet the requirement of sufficient combustion.

2. The technical solutions for solving the technical problems are as follows:

(A) The section A stove core inner ring (2) is made of a selected high-whiteness aluminum silicate fiber, and the section A stove core outer ring (17) is made of foam glass, foam ceramic or calcium silicate modules; the inner and outer rings are bonded and combined to form a thermally insulating/refractory stove core section A; the inner circumferential surface of the section A stove core inner ring (2) is coated with a thin basic optical-thermal reflecting layer formulated with magnesium oxide and a sodium silicate solution of more than 2.8 M; the flame concentrator (6) is made of the selected high-whiteness aluminum silicate fiber, and the inner surface of the flame concentrator is also coated with a thin basic optical-thermal reflecting layer formulated with magnesium oxide and a sodium silicate solution of more than 2.8 M.

The basic optical-thermal reflecting layer brings the following technical effects: 1. The basic inner circumferential surfaces of the section A stove core inner ring (2) and the flame concentrator (6) can prevent them from being sintered and bonded once they contact high-temperature strong basic slag; 2. The temperature of the inner surfaces of the two can be slightly reduced, thus reducing mullitization; 3. The inner surfaces of the two reflect light and heat to the briquette, which is advantageous to reduce the heat loss due to radial conduction through the outer wall of the stove and to quickly form a high-temperature region in the large combustion chamber (7). Multiple ignition tests proved that for an ignition at an air temperature of 20-25° C., after 1 hour, when the scorching briquette region moves down by more than 150 millimeters, the stove outer wall at corresponding section is only in a slightly warm state of about 30-35° C.; 4. Upon coating, the material liquid can penetrate into the inner wall of the stove core and the inner wall of the flame concentrator by about 2-5 mm to seal the micropores therein. As such, fuel gases containing fine carbon particles with good thermal conductivity coefficient caused by incomplete combustion from radially entering the stove core, thus avoiding radial heat loss; in addition, the gas in the micropores of the stove core can be prevented from radially flowing, thus increasing the effective thermal conductivity coefficient and the average thermal conductivity coefficient of the stove core, and having a significant positive technical effect.

The superior technical features of the selected thermally insulating/refractory materials, especially of the high-whiteness alumina silicate fiber include: a thermal conductivity coefficient down to 0.035 W/m·k, and a volumetric weight down to 0.1; capability of long-term use at 1000° C.; low selling price; and use in high-volume production of section A stove core inner ring (2) and flame concentrator (6) in modules by stove core manufacturers, or use in modifying a stove by cutting prefabricated standard modules into required shapes and sizes and conveniently and quickly combining the modules on site in a building block manner.

According to the requirement of the stove shown in FIG. 1, the thermally insulating/refractory section A stove core is made of the selected high-whiteness aluminum silicate fiber in its inner ring (2) and foam glass, foam ceramic or calcium silicate modules in its outer ring (17), with a preferred wall thickness of 20+20 mm. The section B can be made of conventional thermally resistant materials or the same materials as the section A. The whole section of the stove core can also be made of a high-whiteness aluminum silicate fiber, giving a slightly higher cost.

As for the thermally insulating material (3) filling the space outside the stove core, expanded perlite (or hollow vitrified microbeads) can be selected for low-grade stoves, and flyash floating beads from thermal power plants or hollow glass microbeads from specialized manufacturers (waste glass can partially be used) can be selected for medium/high-grade stoves. Preferably, the particle size of the microbeads is distributed continuously to give a maximized thermal insulating effect.

(B) Referring to FIG. 2, for the cylindrical underlying briquette (9) with a diameter down to 100 mm and difficulties in aligning vent holes, the part at the top corresponding to the inner ring vent holes (13) is pressed into a concave shape. As such, when an upper underlying briquette (9) or a pyrophoric briquette (10) is stacked up, risks of blocking for all vent holes are eliminated by visually aligning the outer circumferential surfaces of the upper and lower underlying briquettes and any one of the outer ring vent holes (12), or by visually aligning two of the outer ring vent holes (12) radially arranged, which is simple, rapid and reliable.

(C) Again referring to FIG. 2, after multiple tests, it is confirmed that expanding the overall cross-sectional area of the vent holes for the exemplified underlying briquette (9), the pyrophoric briquette (10) and pyrophoric cake (8) with a 100-mm diameter, and the area of the air inlet and slag outlet opening (5) at the bottom of the stove to 1768 square millimeters, i.e., expanding the overall cross-sectional area of the vent holes by more than 30% as compared with the existing market available smokeless briquette with the same diameter, is a necessary proportion for realizing a smokeless combustion in the whole process. In addition, this scheme adopts an arrangement mainly expanding the area of the 4 inner ring vent holes (13), which expands the diameter of the inner ring vent holes (13) by 3 mm to 15 mm, and expands the diameter of the outer ring vent holes by 1 mm to 13 mm. When the diameter of the inner ring vent holes (13) is expanded by 4 mm to 16 mm and the diameter of the outer ring vent holes (12) is expanded by 1 mm to 13 mm, the overall cross-sectional area of the vent holes are expanded by 37.6%; when the diameter of the inner ring vent holes (13) is expanded by 4 mm to 16 mm and the diameter of the outer ring vent holes (12) is expanded by 2 mm to 14 mm, the overall cross-sectional area of the vent holes is expanded by 50%, which is regarded as the upper limit. This provides a good necessary condition for a long-term complete combustion with a semitransparent and light blue flame. This also provides great fire power, and is suitable for certain applications such as melting and recycling waste aluminum, waste lead and the like, with concerns of reducing the area of vent holes in the ignition stage. Expanding the holes may overcome the defects of insufficient oxygen in the main torch through only a secondary air inlet (4) at the top section of the briquette stack. This provides the main torch with an oxygen supplying effect similar with secondary air inlet and is another powerful technical measure for ensuring the smokeless, efficient and clean combustion of the briquette stack in a whole process.

(D) It can be directly and unambiguously determined from FIG. 1 of the specification that: height of large combustion chamber (7)=height of section A stove core−height of pyrophoric briquette (10)−height of pyrophoric cake (8)−height of straw/charcoal grate (11). As such, the height of the large combustion chamber (7) of the exemplary stove=133−8−50 [height of 200-gram pyrophoric briquette (10)]=75 (millimeters). This is significantly different from existing stoves which burns anthracite briquettes with the same diameter and has a small combustion chamber, and is specially designed for a quick and complete combustion of the fuel gases from a pyrophoric briquette (10) with the formula characteristics of more than 40% of volatile component and quick formation of a high-temperature region in the large combustion chamber (7). For a pyrophoric briquette (10) with high volatile component content, a high ambient temperature and a high stove temperature, the weight of the pyrophoric briquette can be reduced to about 180 g and the height of the large combustion chamber (7) is 80 mm; otherwise, the height should be 70 mm. When the volatile component in the formulation of the underlying briquette (9) is higher, an 80-mm height of the large combustion chamber (7) is also required. Since the height of the large combustion chamber (7) and the height of the pyrophoric briquette (10) are in a dynamic balance, their explicit heights are not separately indicated in FIG. 1.

3. The beneficial technical effects of the technical solutions are as follows: the novel stove and core stove of the present invention can ideally match the briquette stack of the parent patent (Application No. 201810390637.4), such that a smooth ignition can be implemented in a smokeless state in a freezing cold weather, a large combustion chamber (7) and a high-temperature region in the pyrophoric briquette (10) section can be quickly formed, and the scorching briquette region can move down faster according to the design speed, thus realizing a long flame combustion in most of the process and a complete combustion with a high thermal efficiency, a high sulfur fixing rate and a smokeless state during the whole process. The present invention is either suitable for high-volume production of standard stove cores and flame concentrators in modules, or conveniently, quickly and cost-efficiently used to modify various stoves by cutting and combining prefabricated standard stove core and flame concentrator modules of different shapes and sizes on site in a building block manner.

The technical effects of exemplary stoves, stove cores and assorted briquette stacks confirmed by multiple ignition/combustion tests have completely demonstrated the substantial progress of the novel technical features, and a good industrial practicability can be reasonably predicted.

Figure 1:
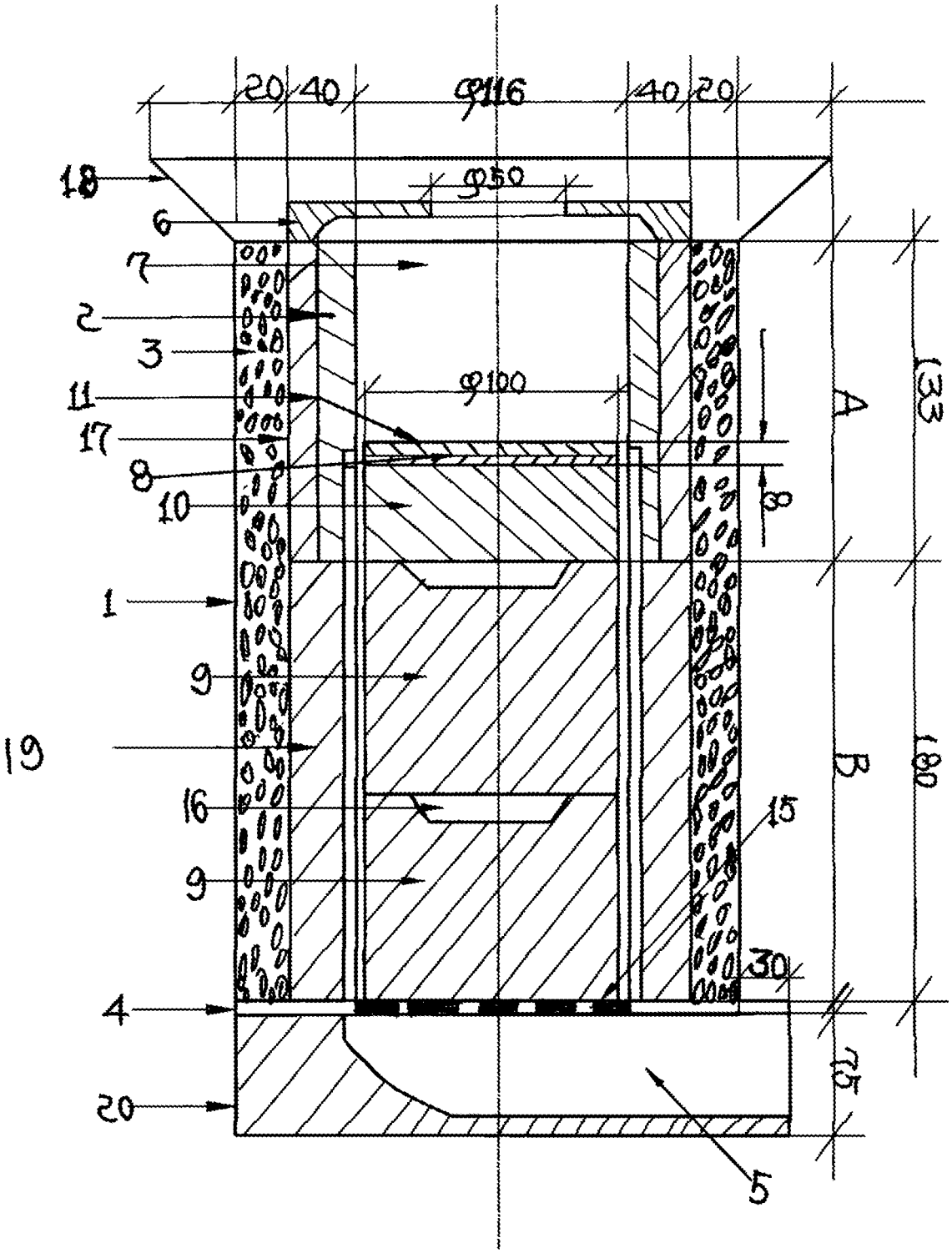
FIG. 1 illustrates the front radial cross-sectional view of a small stove assorted with the smokeless combustion of a cylindrical briquette with a diameter of 100 mm for warming, heating, cooking, production and operation used by scattered facilities, small/micro enterprises, scattered commercial/resident/peasant/farming households and the like, and is also designated as the drawing of the abstract.
Figure 2:
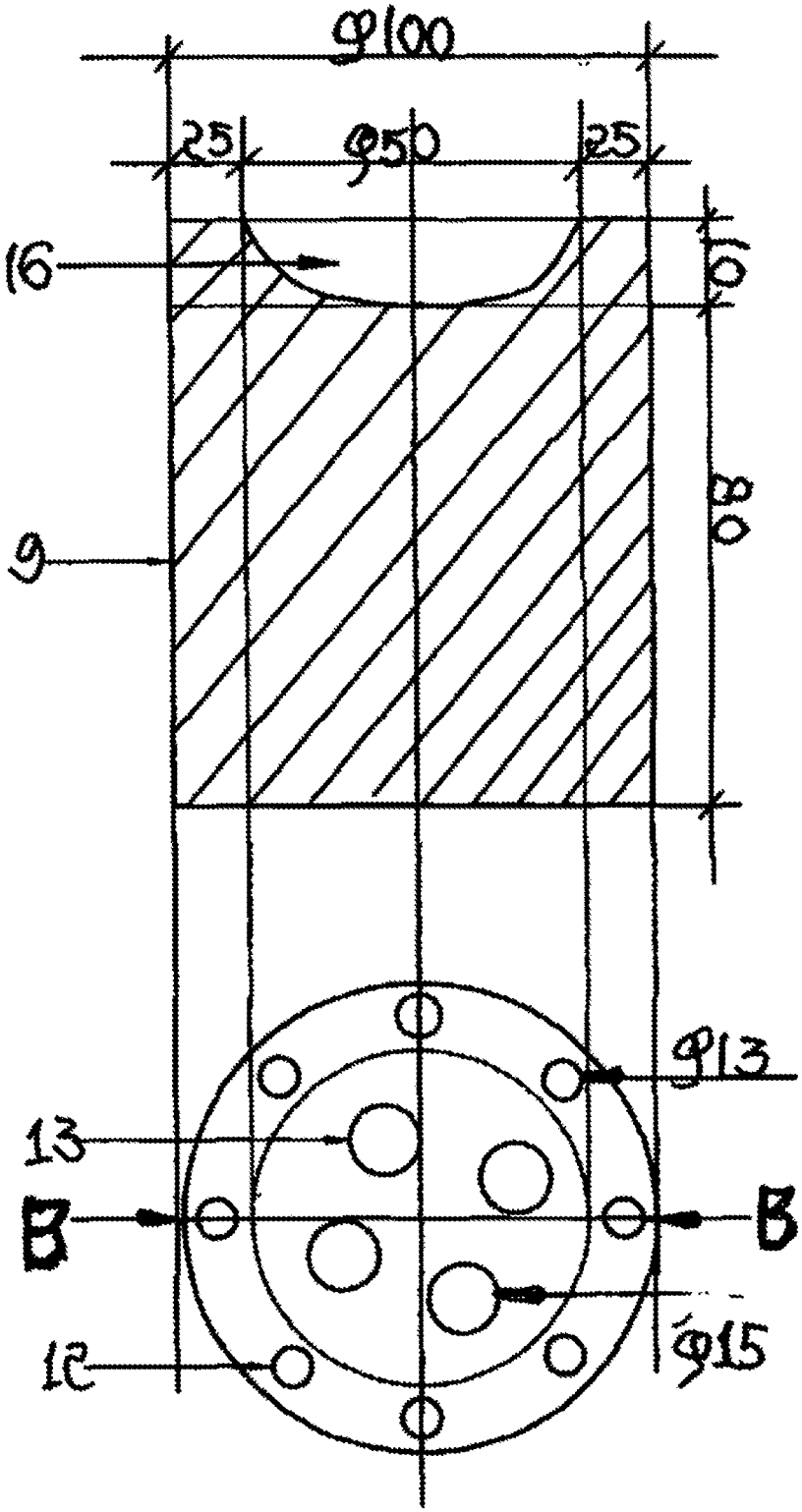
FIG. 2 illustrates a front radial cross-sectional view and a top view (arrangement of vent holes on a briquette) of an assorted underlying briquette (9) of a concave top.

1 is an iron sheet stove shell, 2 is a section A stove core inner ring, 3 is a stove core outer thermally insulating layer, 4 is a secondary air inlet pipeline, 5 is an air inlet and slag outlet opening, 6 is a flame concentrator, 7 is a large combustion chamber, 8 is a pyrophoric cake, 9 is an underlying briquette, 10 is a pyrophoric briquette, 11 is a straw/charcoal grate, 12 is a vent hole outer ring, 13 is a vent hole inner ring, 14 is a lateral ventilation channel at bottom of straw/charcoal grate (not shown in the figures, please refer to the drawings of the parent patent), 15 is a stove grate, 16 is a top recess of underlying briquette, 17 is a section A stove core outer ring, 18 is a top shelter ring [including cover of stove core outer thermally insulating layer (3), not indicated with size], 19 is a section B stove core, 20 is a conventional thermally insulating/refractory material layer at the stove bottom, 21 is a flame concentrator central torch hole, and 22 is a flame concentrator pressure/volume balance hole

DETAILED DESCRIPTION

1. After preparing a conventional thermally insulating/refractory material layer (20) at the stove bottom, a stove grate (15) and a section B stove core (19) are placed on the layer. A section A stove core inner ring (2) in its whole or in two semicircles and coated with a thin layer of basic optical-thermal reflecting material on the inner circumferential surface and an A section stove core outer ring (17) of which the inner circumferential surface is coated with a binder and liquid sodium silicate of more than 2.8 modules are bonded and combined to form a section A stove core, which is then placed above the section B stove core. A secondary air inlet pipeline (4) made of iron sheet is mounted, an outer thermal insulating layer (3) of the stove core is applied, and a cover and a top shelter ring (18) are mounted to form an assorted stove for the novel stove core.

Figure 3:
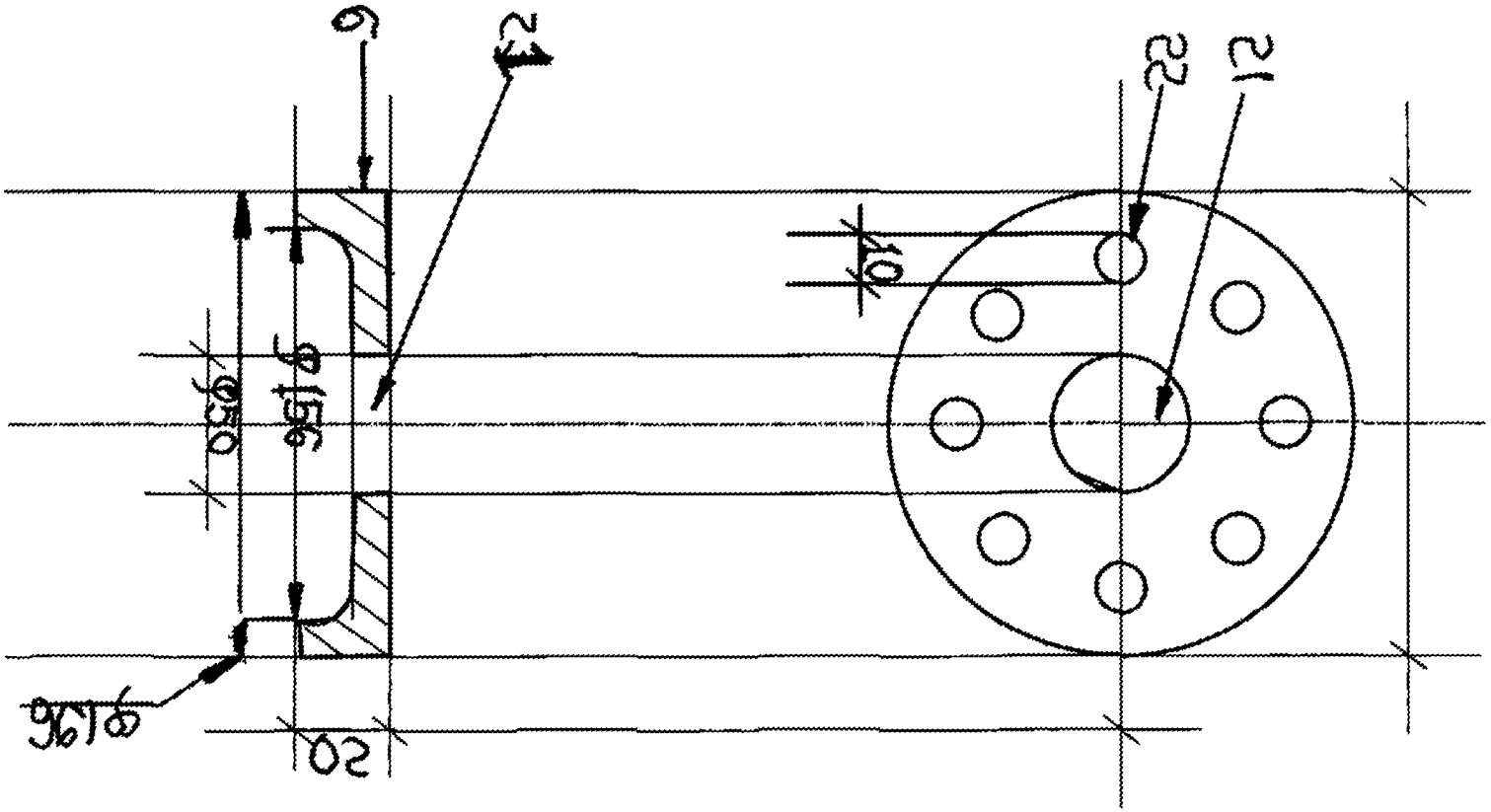
FIG. 3 illustrates a top view and a front radial cross-sectional view of an assorted flame concentrator (6)
Figure 4:
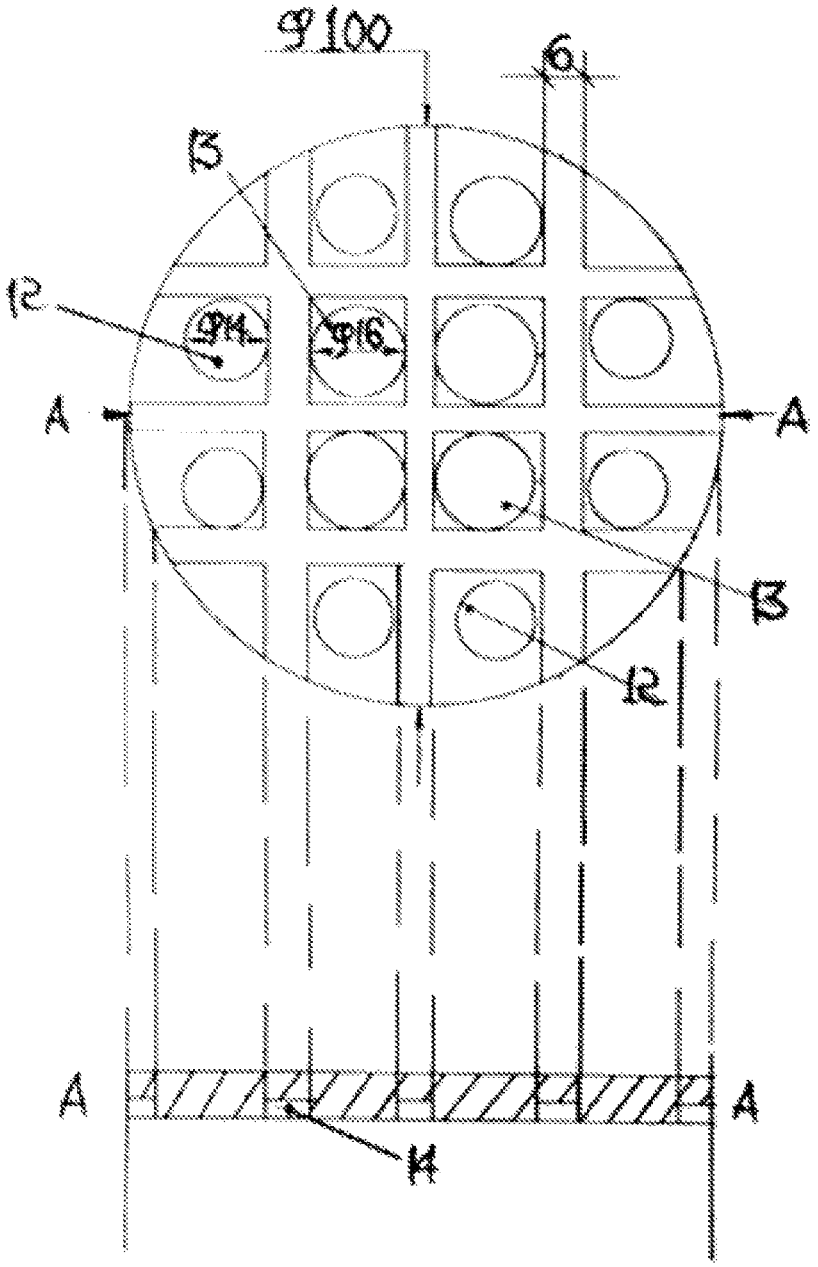
FIG. 4 illustrates a front radial cross-sectional view and a top view of a straw/charcoal grate (11). Names of the various components in the four figures are as follows (ash hopper is quite common and is thus not numbered in the figures)

2. A flame concentrator (6) according to FIG. 3 is produced.

3. Two underlying briquettes (9) and one pyrophoric briquette (10) are sequentially added, and the vent holes are aligned according to the method in this disclosure.

4. A pyrophoric cake (8) and a straw/charcoal grate (11) are placed on the pyrophoric briquette (10), and the vent holes are visually aligned. The air inlet and slag outlet opening (5) is adjusted to a position covering about ⅙, ⅕ or ¼ of the ventilation area by using an ash hopper.

5. A small pinched paper strip of about 50 mm long is placed onto the surface of the straw/charcoal grate (11). The pyrophoric cake (8) is easily ignited in a smokeless state. The flame concentrator (6) is mounted and a large torch flame is quickly formed.

6. When the pyrophoric cake (8) is about to burn out or is burnt out in about 2-5 minutes, the flame length is generally shortened, which indicates the key moment for a successful smokeless ignition. At the moment, the straw/charcoal grate (11) is ignited and scorching to play a role in thermal insulation and continuously igniting the surface layer of the pyrophoric briquette (10). Soon the long flame combustion state is restored, and successful ignition becomes a probable event. If the flame is shortened to a greater extent or is about to disappear, the air supply should be reduced immediately. As long as the top vent holes of the pyrophoric briquette (10) are still scorching or have tiny flame, the long flame combustion state can be restored soon. After getting familiar with procedures, flameout will no longer be a concern. The air supply is increased after a few minutes until the firepower meets the requirements.

7. Within 10 minutes, (it can be observed that) the upper layer of the pyrophoric briquette (10) starts scorching at the height of about 5-10 mm, the large combustion chamber (7) also starts scorching, and a high-temperature region above the briquette stack is formed, which indicate that the briquette stack formally comes to a continuous good combustion state.

8. After the briquette stack is burnt out, or the scorching state disappears, the slags are slightly stirred to drop them into the ash hopper. The raw materials and auxiliary materials of the briquette do not contain toxic and harmful substances. The sulfur contained in the raw material is oxidized and neutralized into sulfate salts of calcium, potassium, magnesium, sodium and iron in the course of combustion. The aqueous solution of the slag has a pH of 7-8, and may be used to produce a weak basic compound fertilizer by mixing with the retted green grass fertilizer (if necessary, other fertilizer components such as potassium humate and the like may be added), which is suitable for improving the granular structure and increasing the fertility of acidic clay. The slag of briquette made of a fuel (such as garbage) containing toxic heavy metal elements shall not be used as fertilizer and should be separately disposed.

9. A simple small/micro stove can intermittently employ the smokeless combustible briquette according to steps 1-8; the static-state, smokeless, efficient and clean combustion effect without air supply produces an exhaust gas with a cleaning degree similar to that of natural gas, which contains a lower fraction of nitrogen oxide than natural gas and thus can be directly discharged.

Simple and cheap auxiliary materials, which are arranged inside the chimney and used for collecting trace dust, nitrogen oxides, sulfur oxides and trace volatile organic matters, further improve the cleanness of the exhaust gas close to that of natural gas. Please pay attention to the subsequent patent application of the applicant.

The present invention is illustrated by exemplary stoves, stove cores and shapes of briquette having a diameter of 100 mm with reference to the attached FIGS. 1, 2, 3 and 4, but is not limited thereto. Stove for non-forced combustion application varies in type. Briquettes of a cylindrical or rectangular columnar shape, large or small size, various combustible solids or semisolids and various formulations, is capable of using the thermally insulating/refractory stove core and the design of a large combustion chamber, the concave shape at the top of the underlying briquette and the expansion and reasonable arrangement of the vent holes. Along with other technical contents of Patent Application No. 201810390673.4, a smokeless, efficient and clean combustion in the whole process may be realized. Therefore, these all fall within the protection scope of the present invention.

Please note that another set of subsequent patent applications assorted with the development and application of the present series of technologies, which are smokeless combustion techniques of the present invention integrated applicable to straw power plant, waste incineration power plant and coal-fired thermal power plant with a power of 300 MW or less, such that the plants are converted into centralized heating facilities producing low-pressure steam. Suitable fuels include: bituminous coal, water-containing lignite, weathered coal, peat, coke powder, coal gangue, coal slime, petroleum coke and coal coke containing more than 5% of sulfur, oil shale with high volatile content, straw and other agricultural and forestry wastes, waste plastics, waste rubber wheel and other artificial polymer wastes, waste oil materials, combustible domestic and industrial garbage. As such, a smokeless, efficient and clean combustion in its whole process may be realized.

The invention claimed is:

1. A stove for smokeless combustion of combustible solids/semisolids, comprising:

a first section in an upper part of the stove, a flame concentrator (6) disposed upon the first section, a slag outlet opening (5) in a lower part of the stove, a pyrophoric briquette (10) in a stove core and an underlying coal briquette (9) under the pyrophoric briquette (10), wherein the stove core resides in the first section and comprises a stove core inner ring (2) and a stove core outer ring (17) that are bonded together, and wherein the stove core inner ring (2), the flame concentrator (6) or the whole core are made of high-whiteness aluminum silicate fibers, the stove core outer ring (17) is made of foam glass, foam ceramic, or calcium silicate, and wherein the underlying coal briquette (9) is cylindrical in shape and comprises a recess on a top of thereof.

2. The stove according to claim 1, wherein the stove core inner ring (2) and the flame concentrator (6) are made of a high-whiteness aluminum silicate fiber, and the inner circumferential surface of the stove core is coated with a thin layer of magnesium oxide and a liquid basic mixture containing sodium silicate of more than 2.8 M, so as to increase the photo-thermal reflection effect, prevent the basic high-temperature slag from being adhered to the inner circumferential surface of the stove core, and block micropores to reduce radial heat loss, wherein the stove core inner ring (2) and the flame concentrator (6) are produced in modules for assembly of the stove, or by cutting and processing prefabricated standard modules on site, and the stove core is wrapped with a thermally insulating material (3).

3. The stove according to claim 1, wherein the underlying briquette (9) is a cylindrical in shape and has a diameter of 100 mm, a recess of a corresponding portion of an inner ring vent hole (13) is 10 mm and is in alignment with an outer circumferential surface of stacked briquettes, and any one of the outer ring vent holes (12) in the briquettes is aligned or two radially arranged outer ring vent holes (12) in the briquettes are aligned simultaneously.

4. The stove according to claim 1, wherein an overall cross-sectional area of the vent hole is expanded by 30-50%.

5. The stove according to claim 1, wherein a height of the pyrophoric briquette (10) is in a dynamic balance relationship with a height of the large combustion chamber (7), wherein the height is adjusted by the following method: greater contents of volatile component in the composition of the pyrophoric briquette (10) and the underlying briquette (9) and greater ambient and stove temperatures lead to a greatest height of the large combustion chamber (7), vice versa.

* * * * *